US007841314B2

(12) United States Patent
Nakashima et al.

(10) Patent No.: US 7,841,314 B2
(45) Date of Patent: Nov. 30, 2010

(54) COOLING STRUCTURE OF CONSTRUCTION MACHINE

(75) Inventors: Hajime Nakashima, Hiroshima (JP); Tomoya Taniuchi, Hiroshima (JP); Yasumasa Kimura, Kobe (JP); Shinichi Kinoshita, Kobe (JP)

(73) Assignee: Kobelco Construction Machinery Co., Ltd., Hiroshima-shi (JP)

( * ) Notice: Subject to any disclaimer, the term of this patent is extended or adjusted under 35 U.S.C. 154(b) by 505 days.

(21) Appl. No.: 11/722,548

(22) PCT Filed: Dec. 26, 2005

(86) PCT No.: PCT/JP2005/023766

§ 371 (c)(1),
(2), (4) Date: Jun. 22, 2007

(87) PCT Pub. No.: WO2006/070733

PCT Pub. Date: Jul. 6, 2006

(65) Prior Publication Data

US 2008/0223319 A1 Sep. 18, 2008

(30) Foreign Application Priority Data

Dec. 27, 2004 (JP) ..... 2004-377801
Dec. 27, 2004 (JP) ..... 2004-377802

(51) Int. Cl.
*F02B 77/04* (2006.01)
*F02B 77/13* (2006.01)

(52) U.S. Cl. ..... 123/198 E; 181/204; 180/68.1

(58) Field of Classification Search ..... 123/198 E; 181/204; 180/68.1
See application file for complete search history.

(56) References Cited

U.S. PATENT DOCUMENTS 3,812,927 A * 5/1974 Kawamura ..... 180/68.1

FOREIGN PATENT DOCUMENTS

JP 48-64633 9/1973
JP 54-69203 6/1979

(Continued)

OTHER PUBLICATIONS

U.S. Appl. No. 12/013,710, filed Jan. 14, 2008, Kinoshita, et al.

*Primary Examiner*—Noah Kamen
(74) *Attorney, Agent, or Firm*—Oblon, Spivak, McClelland, Maier & Neustadt, L.L.P.

(57) ABSTRACT

To improve soundproof performance on an air intake side of a cooling structure of a construction machine without enlarging an air intake chamber. An air intake chamber is provided on the air intake side of a heat exchanger in an engine room, and a first air intake port is formed in a top face of the air intake chamber. In the air intake chamber, a duct independently formed as a shield member is disposed so as to partition the air intake chamber into two chambers, and also such that the core surface of the heat exchanger is enclosed airtightly from the surrounding atmosphere. A second air intake port is formed in the duct; thereby, the air intake chamber is constituted in a doubled duct structure, and air sucked from the first air intake port is guided through an air intake passage to the core surface of the heat exchanger, the air intake passage being bent so as to be roughly L-shaped.

21 Claims, 12 Drawing Sheets

FOREIGN PATENT DOCUMENTS

| | | |
|---|---|---|
| JP | 58-129066 | 8/1983 |
| JP | 2 87936 | 7/1990 |
| JP | 2 134826 | 11/1990 |
| JP | 4 1626 | 1/1992 |
| JP | 8 218869 | 8/1996 |
| JP | 11-240342 | 9/1999 |
| JP | 2004 3398 | 1/2004 |
| JP | 2004-353539 | 12/2004 |

* cited by examiner

COOLING STRUCTURE OF CONSTRUCTION MACHINE

TECHNICAL FIELD

The present invention relates to a cooling structure of a construction machine having an improved soundproof performance on its air intake side, through which cooling air taken from the outside is fed to a heat exchanger.

BACKGROUND ART

For example, a hydraulic excavator is equipped with an engine room (2) in the rear of its upper turning body (1), and an engine (3) and a hydraulic pump (4) driven thereby are provided in the engine room (2) as shown in FIGS. 25, 26.

In the opposite side of the hydraulic pump (4), there are installed a plurality of heat exchangers (5) such as a radiator for cooling the engine, an oil cooler, an intercooler, and the like (herein shown as one unit), and a cooling fan (6) driven by the engine (3); as the cooling fan (6) is rotated, as shown by an arrow in the attached figures, air sucked from the outside into the engine room (2) is passed through the heat exchanger (5) and discharged from an exhaust port (not shown).

The engine room (2) is formed by being enclosed with a cover member (7), utilizing a panel member called as an engine guard, a portion of a counterweight, a top face of a fuel tank, or the like and an air intake port (8) is provided in the cover member (7).

The air intake port (8) is formed in a side face (the face opposing the heat exchanger (5)) or in a top face of the cover member (7) on the side where the heat exchanger (5) is located. In FIG. 25, reference numeral (9) denotes a cabin.

This structure, however, has a problem of low soundproof performance, since any measures against air intake noise such as fan rotation noise, fan wind noise, suction noise of the heat exchanger, and the like have not been taken, and consequently most of the noise leaks outside directly through the air intake port (8).

As measures for overcoming the problem, as disclosed in Patent Document 1, an art is proposed in which a cooling air passage is arranged in an angular U-shaped configuration in plan view by extending the air intake space of an engine room toward the front of a machine, and an air intake port is provided at an end face of the air passage, the end face being oriented toward the center of the machine.

Patent Document 1: Japanese Unexamined Patent Application Publication No. H08-218869

DISCLOSURE OF INVENTION

When compared to a conventional art shown in FIGS. 25, 26, the above known art has advantages that a soundproof effect is obtained by blocking direct sound with an air intake chamber wall extended from the core surface of a heat exchanger to the air intake port, and a sound reflection-attenuation effect is also obtained through the long, bent air intake passage.

The basic soundproof effect with this structure, however, is low since what is obtained is only an attenuation effect with the chamber wall (cover member) of the air intake chamber. Furthermore, airtightness of the air intake chamber is not enough due to clearances in the chamber wall, so the air intake chamber allows sound to leak a lot. In these points, the soundproof performance on the air intake side of the structure is still unsatisfactory.

Additionally, there is a problem such that the air intake chamber extended toward the front of the machine encroaches on an installation space for other equipment (for example, a cabin (9) shown in FIG. 25) mounted on the upper turning body, which becomes disadvantageous for a machine such as a small-sized excavator, especially called a small rear-swing radius type, or the like, the small-sized excavator being basically tight in space.

The object of the present invention is to improve soundproof performance on the air intake side of an air intake chamber without enlarging the space thereof.

In order to solve the above problems, the following configuration is employed in the present invention.

In a cooling structure of a construction machine configured so that an engine, a heat exchanger and a cooling fan are installed in an engine room covered with a shield member, and outside air is sucked by rotation of the cooling fan to be passed through the heat exchanger, an air intake chamber is independently formed in space on the air intake side of the heat exchanger in the engine room; a first air intake port open to the outside is provided in the chamber wall of the air intake chamber composed of shield members; a shield member having a face opposing the core surface of the heat exchanger is provided in the front side of the core surface so as to partition the air intake chamber disposed between the core surface and the first air intake port into two chambers; and a second air intake port is provided in the face of the shield member opposing the core surface.

In an aspect of the present invention, a duct is independently formed using a duct material different from the cover member in a manner such that the core surface of the heat exchanger is enclosed airtightly from the surrounding atmosphere.

In the other aspect of the present invention, a shield plate is provided as a shield member so as to partition the space disposed between the core surface and the first air intake port over the full width of the air intake chamber.

According to the present invention, the following effects are obtained.

(A) Sound (direct sound) being emitted from the core surface of a heat exchanger directly toward the outside can be intercepted by a shield member and is suppressed from being dissipated.

(B) A sound reflection-attenuation effect can be obtained by both a chamber wall (cover member) of the air intake chamber and a shield member.

(C) Sound leakage through clearances in the chamber wall can be prevented, since the air intake chamber is formed in a doubled structure by being partitioned with the shield member.

(D) A sound attenuation effect caused by being squeezed with the shield plate can be obtained.

From those features, it becomes possible to significantly increase the soundproof effect on the air intake side, compared with a conventional structure shown in FIGS. 25, 26 as a matter of course, even compared with the prior art disclosed in Patent Document 1.

Additionally, since the above effects are obtained by providing shield members in the air intake chamber, it is not necessary to enlarge the air intake chamber as done in the prior art; therefore, such a drawback that an installation space for other equipment is encroached on does not arise and the structure can be easily applied to existing machines.

Also, since a doubled duct structure is provided by independently forming a duct as a shield member in the air intake chamber, (a) a sound attenuation effect is increased through repeated reflection and attenuation of sound in the duct, (b) an effect of preventing sound from leaking from the air intake chamber is increased, and (c) another effect of sound attenuation can be obtained by squeezing sound with the doubled duct structure.

Additionally, since the duct is formed so as to enclose the core surface of a heat exchanger, direct sound being emitted from the core surface to the outside can be intercepted by the duct merely by keeping airtightness between the duct and the periphery of the core surface.

That is, when a duct is not provided, the whole of the air intake chamber having a complex configuration should be airtightly sealed to prevent direct sound from leaking, but it very difficult to perfectly seal the inner surface of the cover member often including three dimensionally curved surfaces.

On the other hand, the present invention provides an outstanding sealing performance by forming a duct, the sealing area of which is far less than that of a conventional structure and can be easily sealed.

BEST MODE FOR CARRYING OUT THE INVENTION

Examples of the present invention will be described with reference to the attached figures, FIG. 1 to FIG. 24.

In Examples 1 to 7 shown in FIG. 1 to FIG. 13, a duct is provided as a shield member respectively, while in Examples 8 to 13 shown in FIG. 14 to FIG. 24, a shield plate is provided as a shield member respectively.

EXAMPLE 1

Figure 1:
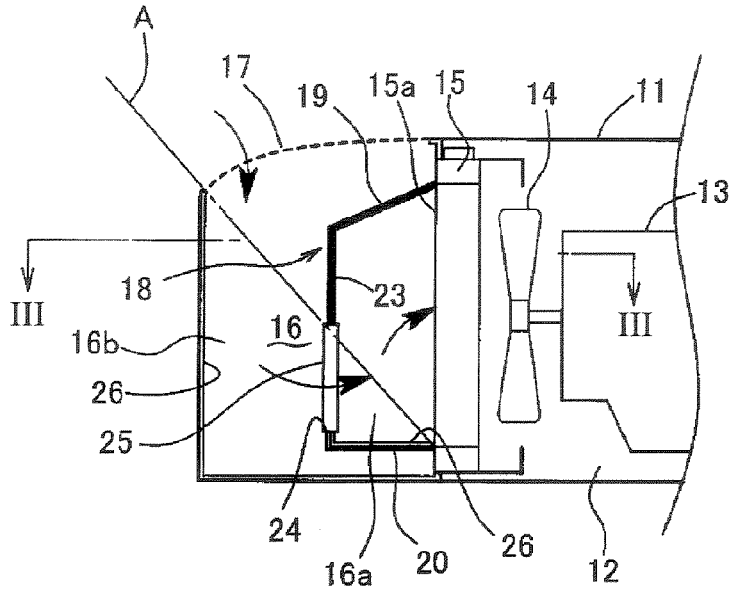
FIG. 1 is a schematic cross-sectional view showing Example 1 of the present invention.
Figure 2:
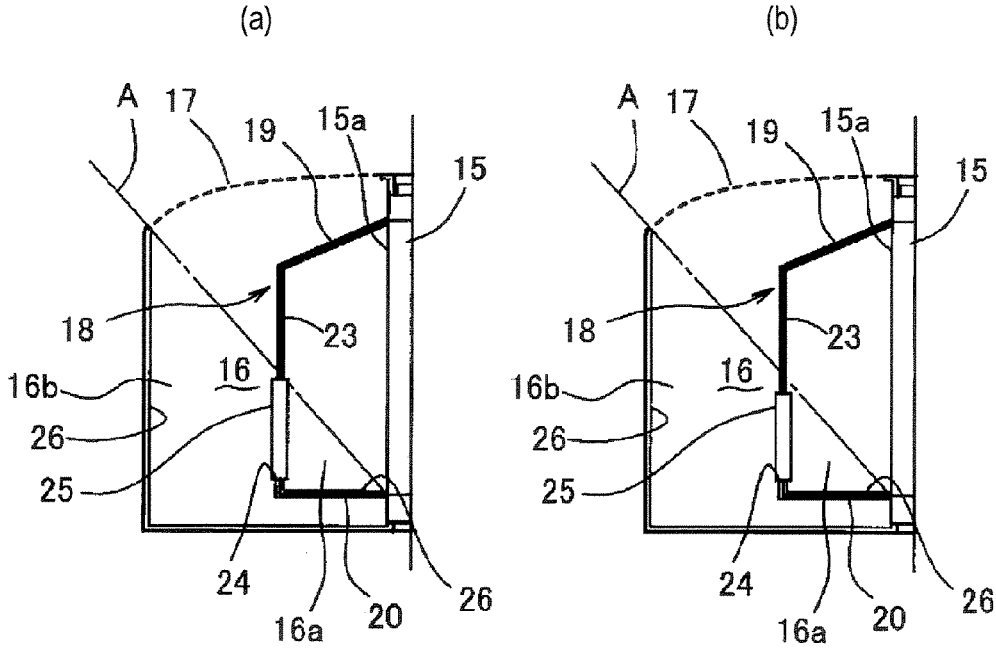
FIGS. 2(*a*), (*b*) are partial cross-sectional views showing other two examples for the position of the upper end of a second air intake port.
Figure 3:
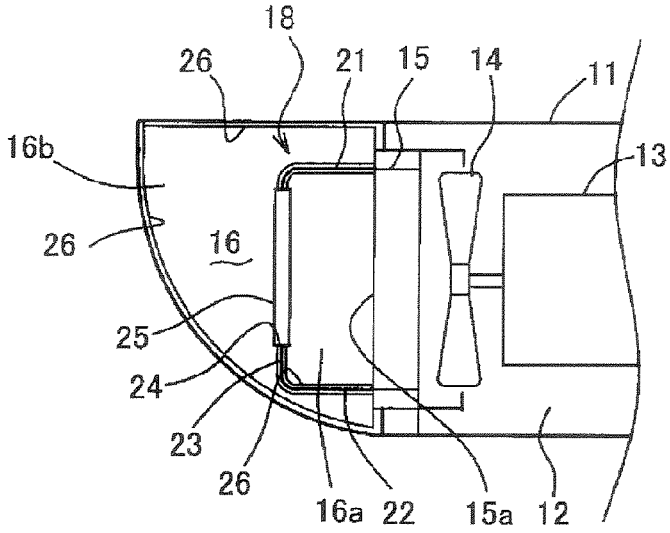
FIG. 3 is a cross-sectional view taken from line III-III of FIG. 1.

(See FIG. 1 to FIG. 3)

An engine room (12) covered with a cover member (11) such as a portion of an engine guard or a counterweight, a top face of a fuel tank, or the like is provided on the rear portion of an upper turning body. In the engine room (12), there are provided an engine (13), a hydraulic pump (not shown), a cooling fan (14), and a heat exchanger (15) such as a radiator (herein shown as one unit).

An air intake chamber (16) is formed in the air intake side of the heat exchanger (15) in the engine room (12), and a first air intake port (17) for taking cooling air from the outside is formed in the upper surface portion of the air intake chamber (16) (the top face of the cover member (11)).

In the engine room (12), the air intake chamber (16) is formed by being separated (in a manner that an airflow is intercepted) from the space in which engine (13) and the like are installed, by means of the heat exchanger (15), appropriate partition members and sealing members, the air intake chamber (16) being provided with a duct (18).

The duct (18) is formed in a shape of an independent box having a top plate (19), a bottom plate (20), and front and rear side plates (21), (22), and a front-located end plate (23), using a duct member different from the cover member (11).

The duct (18) is installed in a manner such that the front-located end plate (23) is placed in parallel with the core surface (15*a*) of the heat exchanger, and the core surface (15*a*) is enclosed with the duct (18) so as to be sealed from the surrounding atmosphere (for example, so that the periphery of the open end on the back side of the front-located end plate (23) is airtightly in contact with the periphery frame of the core surface (15*a*) of the heat exchanger).

Furthermore, a second air intake port (24) is formed in the front-located end plate (23) being horizontally opened opposing the core surface (15*a*) of the heat exchanger in the duct (18). The second air intake port (24) is provided with a filter (25) covering the second air intake port (24) for dust proof, the filter (25) being mounted in parallel with the core surface (15*a*) of the heat exchanger.

Incidentally, the air flow in the duct (18) is improved by disposing the filter (25) (the second air intake port (24)) in parallel with the core surface (15*a*).

On the other hand, the top plate (19) of the duct (18) is formed so as to be declined toward a forward end (in the direction in which the space between the top plate (19) and the first air intake port (17) becomes larger with distance from the core surface (15*a*) of the heat exchanger) to prevent the first air intake port (17) from being blocked; thereby, sufficient air intake volume can be secured by fully utilizing the open area of the first air intake port (17).

The air intake chamber (16) provided between the core surface (15*a*) of the heat exchanger and the first air intake port (17) is partitioned by the duct (18) into two chambers (16*a*), (16*b*) (a space in the duct and the other space, hereinafter called "a first chamber" and "a second chamber") Thanks to the duct (18), an air intake passage bent in roughly a L-shape is formed; thereby, outside air taken through the first air intake port (17) in a downward direction as shown by an arrow in FIG. 1 is directed sideway at the second air intake port (24) and is led to the core surface (15*a*) of the heat exchanger.

Since the core surface (15*a*) of the heat exchanger is enclosed with the independent duct (18) and the air intake passage connecting between the core surface (15*a*) and the outside is bent so as to be roughly L-shaped, direct sound being emitted directly toward the outside can be intercepted by the duct (18).

In this case, relative positions of the first and second air intake ports (17), (24) are set so that any portion of the core surface (15*a*) of the heat exchanger should not be directly seen from the outside through both the air intake ports (17), (24).

Specifically, the top edge of the second air intake port (24) is positioned on or below a straight line (A) connecting between the bottom edge of the core surface (15*a*) of the heat exchanger and the utmost outside of the first air intake port (17).

Thus, direct sound being emitted directly toward the outside can be certainly intercepted by the duct (18).

According to this layout, the top edge of the second air intake port (24) is consequentially located below the lowest end of the first air intake port (17) (the portion transitioning to a side face of the machine, shown in the left end of the attached exemplary figures), so there is no fear that sound is emitted directly toward a side of the machine. Namely, "noise on the side of the machine" can be significantly reduced.

In FIG. 1, there is shown a first pattern in which the top edge of the second air intake port is positioned on the straight line (A), but a second pattern in which it is positioned near and slightly below the straight line (A) as shown in FIG. 2(*a*), or a third pattern in which it is positioned apparently below the straight line (A) as shown in FIG. 2(*b*) may also be employed.

If the first or second pattern is employed, it becomes possible to effectively protect leakage of noise without unnecessarily deflecting the airflow, and if the third pattern is employed, a best soundproof effect is exerted.

The top edge of the second air intake port may also be positioned slightly above the straight line (A). Even in this case, an effect similar to the above first to third patterns can be obtained.

On the other hand, air intake sound emitted from the core surface (15*a*) is repeatedly subjected to reflection-attenuation between the first and second chambers (16*a*), (16*b*) in the air intake chamber (16); thereby, a high soundproof effect can be obtained.

Additionally, in comparison with the single duct structure of the air intake chamber (16), since the air intake chamber (16) is structured as an fully doubled duct having the independent duct (18) therein, it is possible to substantially increase its soundproof effect by blocking sound doubly with the cover member (11) forming the air intake chamber (16) and the entire inner surface of the duct (18), and also by squeezing sound with the doubled duct structure.

Furthermore, the core surface (15*a*) of the heat exchanger that is an outlet of sound is enclosed with the duct (18); accordingly, it is possible to control sound so as not to be spread in all directions.

Figure 25:
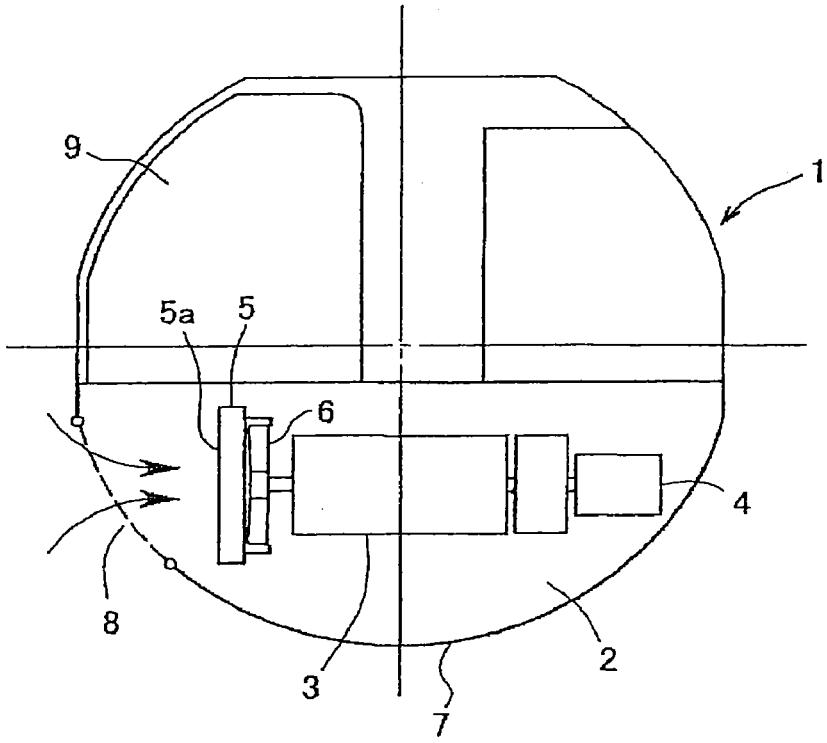
FIG. 25 PRIOR ART
FIG. 25 is an overall plan view showing a conventional structure of an upper turning body of a hydraulic excavator.
Figure 26:
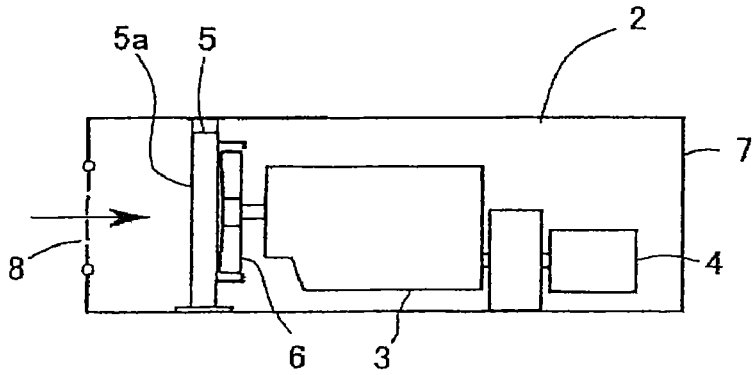
FIG. 26 PRIOR ART
FIG. 26 is a back view of the above.

From these points, the soundproof effect on the air intake side can be considerably increased in comparison with not only the conventional structure shown in FIGS. 25, 26 but also the known art as described in the Patent Document 1.

Additionally, since the effect described above is obtained with a configuration that the duct (18) is installed in the air intake chamber (16), it is not necessary to enlarge the air intake chamber as done in a known art. Therefore, the disadvantage with the known art that installation space for other equipment is encroached on is avoided, and this technique can be easily applied to existing machines.

Since direct sound from the core surface (15*a*) can be certainly intercepted merely by keeping airtightness between the duct (18) and the periphery of the core surface, the area to be sealed becomes limited compared with the case in which an inner cover member (11) having a complex shape including a three-dimensional curved surface is entirely sealed in airtight. Additionally, as sealing work is easily carried out, a high airtightness can be obtained.

The opening area of the second air intake port (24) is smaller than the area of the core surface (15*a*) of the heat exchanger; accordingly, intake noise emitted from the core surface (15*a*) is spread into the second chamber (16*b*) after being once squeezed at the second air intake port (24), which brings about a higher soundproof effect.

Additionally, since the effect described above is obtained with the configuration that the duct (18) is installed in the air intake chamber (16), it is not necessary to enlarge the air intake chamber as done in a known art. Therefore, the disadvantage with the known art that installation space for other equipment is encroached on is avoided, and this technique can be easily applied to existing machines.

On the other hand, since the filter (25) is installed at the second air intake port (24) of the duct (18), the entire quantity of air sucked from the first air intake port (17) flows into the core surface (15*a*) of the heat exchanger after being passed through the filter (25); therefore, the efficiency of removing dust and the like contained in the outside air becomes high.

Compared with the case that the core surface (15*a*) is fully covered with a filter, the filter (25) is formed in a considerably smaller size, and still the same function is ensured, which brings reduction of costs.

There is provided sound-absorbing material (26) on the wall surface of the air intake chamber (16), i.e., the inner surface of the cover member (11) forming the air intake chamber (16), and on the inner and outer surfaces of the duct (18); due to the sound absorption effect of the sound-absorbing material (26), intake noise can be further reduced.

EXAMPLE 2

Figure 4:
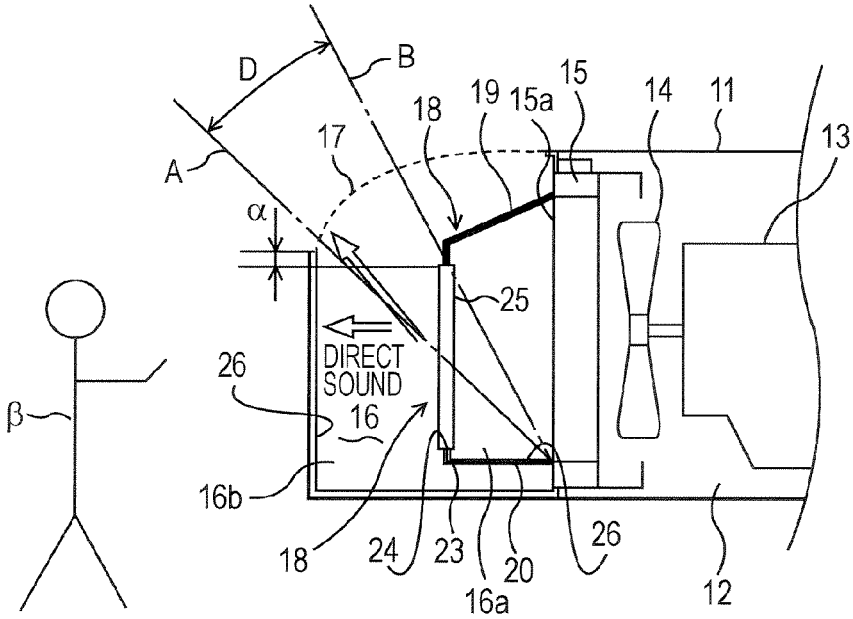
FIG. 4 is a schematic cross-sectional view showing Example 2 of the present invention.

(See FIG. 4)

In order to suppress "noise on the side of the machine" that a man standing near the machine perceives, it is preferable that intake noise is emitted upwardly; therefore, a first air intake port (17) is desirable to be formed in a top face of an air intake chamber (16), or if being extended to a side face of the air intake chamber (16), it is desirable that it ends at a position close to the upper end of the side face as in the case of Example 1.

However, there may be a case that the first air intake port (17) is desirable to be formed so as to be much extended to the side face as shown in FIG. 4, or to be formed just in the side face for convenience of a layout or on requirement for increasing the volume of outside air to be taken.

In Example 1, since the top edge of the second air intake port (24) is positioned on or below the straight line (A) connecting between the bottom edge of the core surface (15*a*) of the heat exchanger and the utmost outside of the first air intake port (17) as described above, the vertical dimension of the second air intake port (24) is limited and the area thereof becomes narrow, which may cause a problem that the air volume taken through the second air intake port (24) is reduced. Furthermore, since the second air intake port (24) is located in a lower position, there arises a fear that the cooling air flowing into the first chamber (16*a*) in the duct via the second air intake port (24) may not be sufficiently delivered to the upper portion of the core surface (15*a*) of the heat exchanger.

Then, it becomes desirable that the vertical dimension of the second air intake port (24) is more extended.

As a configuration responding to such a requirement, in Example 2, the position and size of the second air intake port (24) is firstly set so that the top edge of the second air intake port (24) is positioned above the straight line (A). Specifically, the second air intake port (24) is formed in an extended area from a lower part close to the bottom edge of a front-located end plate (23) to an upper part close to the top edge thereof as shown in the attached figure.

On the other hand, the first air intake port (17) is formed in a large area, extended to the side face from the upper surface portion of the air intake chamber, with a condition that the low end of the first air intake port (17) is positioned above the upper end of the second air intake port (24). The sign (α) in FIG. 4 denotes a position deviation between the low end of the first air intake port and the upper end of the second air intake port.

With this configuration of Example 2, the first air intake port (17) is formed in a large area extended to the side face and also the second air intake port (24) is formed in a vertically extended area, while "noise on the side of the machine" that a worker (β) standing near the machine perceives can be reduced, because the horizontally directed portion of noise being emitted from the core surface (15*a*) of the heat exchanger is blocked by the side face portion of the cover member (11), and only the upwardly directed portion of noise is dissipated upward from the first air intake port (17).

Even in this case, the following basic effects with the configuration that the duct (18) is installed in front of the core surface (15*a*) of the heat exchanger are still assured.

(i) Sound (direct sound) being emitted from the core surface (15*a*) of the heat exchanger directly toward the outside can be intercepted by the duct (18) and its dissipation can be suppressed.

(ii) In addition to a sound reduction effect of the wall member of the air intake chamber (16), a sound reflection-attenuation effect in the independent duct (18) can be also obtained.

(iii) Owing to the doubled duct structure, leakage of sound from the air intake chamber to the outside can be effectively suppressed.

(iv) Another sound attenuation effect is obtained by squeezing sound with the doubled duct structure.

Incidentally, this configuration of Example 2 can be adopted to the case in which the first air intake port (17) is formed only on the side face of the air intake chamber.

EXAMPLE 3

(See FIG. 5 to FIG. 8)

In the case that a second air intake port (24) is formed in an extended area as in Example 2, a portion (C) (hereinafter called "directly visible portion") of the core surface (15*a*) of a heat exchanger that is directly seen from the outside through either of air intake ports (17), (24) appears, so the direct sound emitted from the directly visible portion (C) cannot be blocked by a duct (18).

In example 3, on the precondition that the second air intake port (24) is formed in a extended area, there is provided a curtain plate (27) between the first air intake port (17) and the second air intake port (24) (the duct (18)), the curtain plate (27) having both functions of guiding air and blocking the direct sound.

The curtain plate (27) is configured as an angled plate having an inclined portion (27*a*) inclined in the same direction as the top plate (19) of the duct (18) and a vertical portion (27*b*) downwardly extended from the lower end of the inclined portion (27*a*). The curtain plate (27) is installed so as to cover an area (D) between a straight line (A) and a straight line (B) connecting between the bottom edge of the core surface (15*a*) of the heat exchanger and the upper edge of the second air intake port (24), i.e., so as to shield the directly visible portion (C) from the outside.

The following effects can be obtained by installing the curtain plate (27) as described above.

(a) Since air sucked from the first air intake port (17) is guided separately to the upper and lower portions of the second air intake port (24) by the curtain plate (27), the air can be delivered to the entire area of the second air intake port (24), i.e., to the entire core surface (15*a*) of the heat exchanger.

(b) Since the directly visible portion (C) of the core surface (15*a*) is shielded from the outside by the curtain plate (27), the sound being emitted from the core surface (15*a*) of the heat exchanger directly toward the first air intake port (17) can be perfectly blocked.

Here, from the point of view that leakage of noise should be avoided without unnecessarily deflecting the flow of air, the lower edge of the curtain plate (27) is positioned on the straight line (A) or at a position close, as much as possible, to the line, similarly as with the position of the upper edge of the second air intake port (24) in Example 1.

Figure 7:
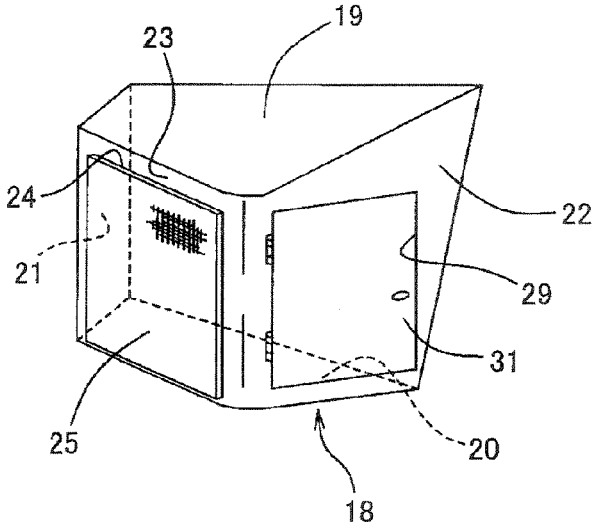
FIG. 7 is a perspective view of a duct in Example 3.
Figure 8:
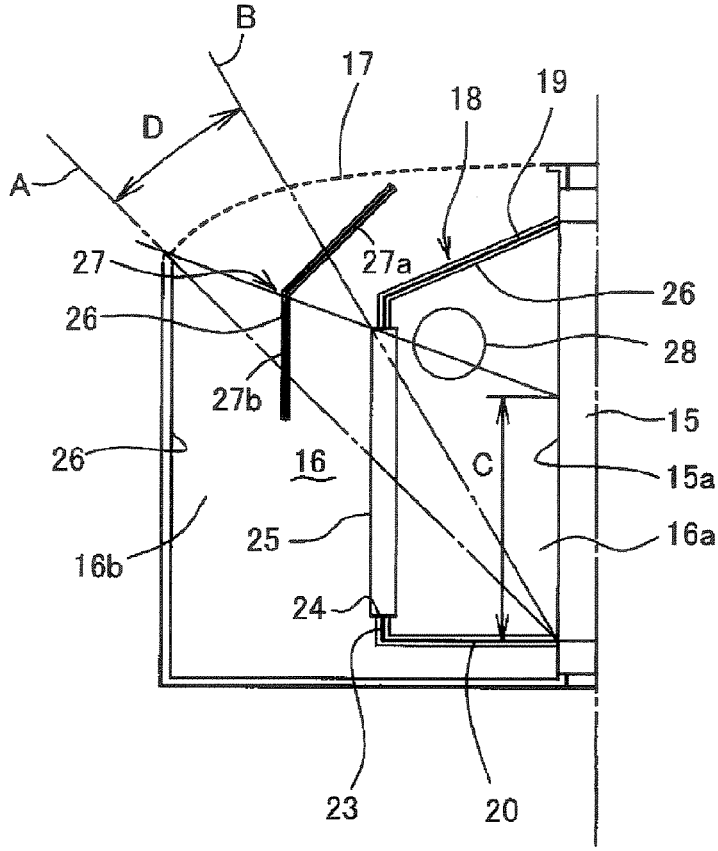
FIG. 8 is a magnified view of a part of FIG. 5.

Although the curtain plate (27) shown in the attached figure extends off upward and downward the area (D) between the straight lines (A), (B) in FIG. 7, it may be installed so as to cover a minimum area including the area (D).

There is also provided the sound-absorbing material (26) on both side surfaces of the curtain plate (27).

In this case, since the curtain plate (27) is formed in an angled-shape, it becomes possible to have a large surface area as a guide plate (27) in the narrow second chamber (16*b*), and accordingly much quantity of the sound-absorbing material (26) can be provided, which enables a high sound absorption effect to be obtained.

On the other hand, being different from Example 1 in which the duct shape is configured so that the front-located end plate (23) (the second air intake port (24) and the filter (25)) of the duct (18) is placed in parallel with the core surface (15*a*) of the heat exchanger, the duct shape in this Example 3 is configured so that the front-located end plate (23) of the duct (18) is inclined with respect to the core surface (15*a*) of the heat exchanger.

The same soundproof effect as in Example 1 can be basically obtained also in this case.

Additionally, in this Example 3, an air cleaner (28) for filtering air being supplied to the engine (13) is provided in the upper portion (or alternatively in the middle or lower portion) of the first chamber (16*a*) in the air intake chamber (16).

With this arrangement, it becomes possible to avoid leakage of air intake sound emitted from the air cleaner (28), while it becomes possible to supply clean air filtered by the filter (25) to the air cleaner (28).

Incidentally, there is a case that a coarse member (wire mesh or the like) for filtering coarse dust is employed as a filter (25). Even in this case, an effect that the air cleaner (28) is protected from sucking coarse dust can be obtained.

Furthermore, since being installed inside the duct, the air cleaner (28) can be protected from rain or the like. At the same time, it becomes unnecessary to provide a separate cover for protecting the air cleaner (28) from rain or the like, which brings about simplification of the structure and a cost reduction.

Figure 5:
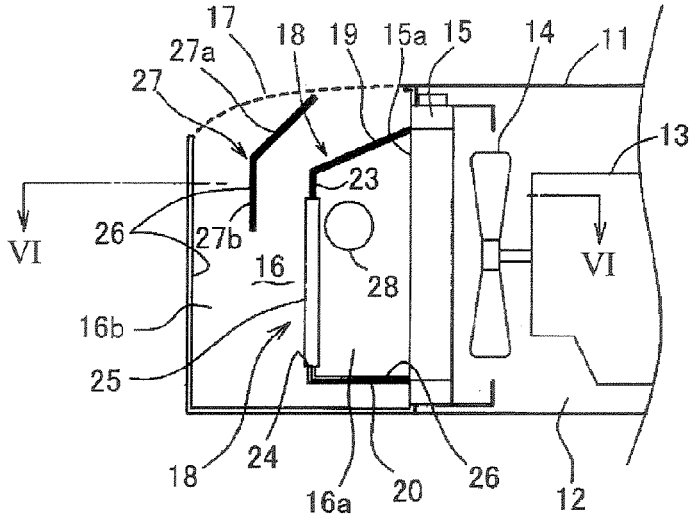
FIG. 5 is a schematic cross-sectional view showing Example 3 of the present invention.
Figure 6:
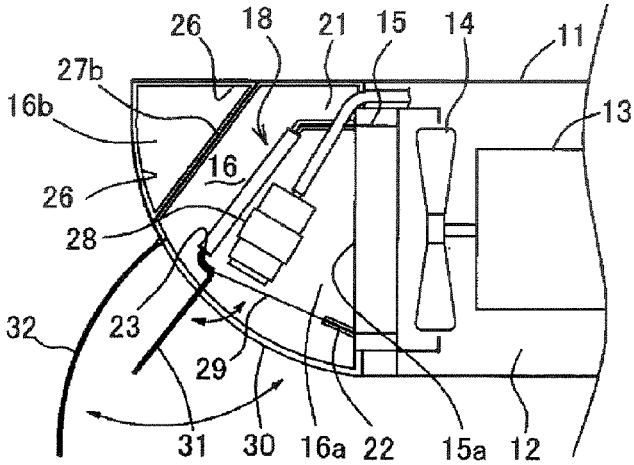
FIG. 6 is a cross-sectional view taken from line IV-IV of FIG. 5.

In order to make it easier to carry out maintenance such as inspection, cleaning, replacement or the like of the element and filter (25) of the air cleaner (28) from the outside, maintenance ports (29), (30) and doors (31), (32) for closing or opening the ports are formed respectively on the side faces (a rear side plate (22) of the duct (18) and a back portion of the cover member (11)) of the duct (18) and the cover member (11) from which the element and filter (25) can be attached or detached as shown in FIG. 5, 6.

It is noted that both the doors (31), (32) may be linked so as to be simultaneously opened or closed, or the whole of the rear side plate (22) of the duct (18) may be integrated into the door (32) of the cover member (11).

It is desirable that each of the maintenance ports (29), (30) has a large area enough to carry out maintenance of the core surface (15*a*) of the heat exchanger as shown in the attached figure.

Related to this point, in the case of a hydraulic excavator called a small rear-swing radius type, since the rear portion of the cover member (11) forming the air intake chamber (16) is configured in an arc-shape in plan view as shown in the attached figure, it becomes possible to pull out or put in the element of the air cleaner (28) diagonally outward, i.e., toward a space where no obstacle exists for forming the maintenance ports (29), (30) on that place. Thus, it becomes easy to pull out or put in the element of the air cleaner (28) for cleaning or the like thereof.

Compared with a conventional machine having a filter on the core surface (15*a*) of the heat exchanger, the filter not being pulled out or put in other than from the top of the hood, maintenance work for the filter (25) becomes remarkably easy because the filter (25) can be pulled out or put in from the ground.

EXAMPLES 4, 5

Figure 9:
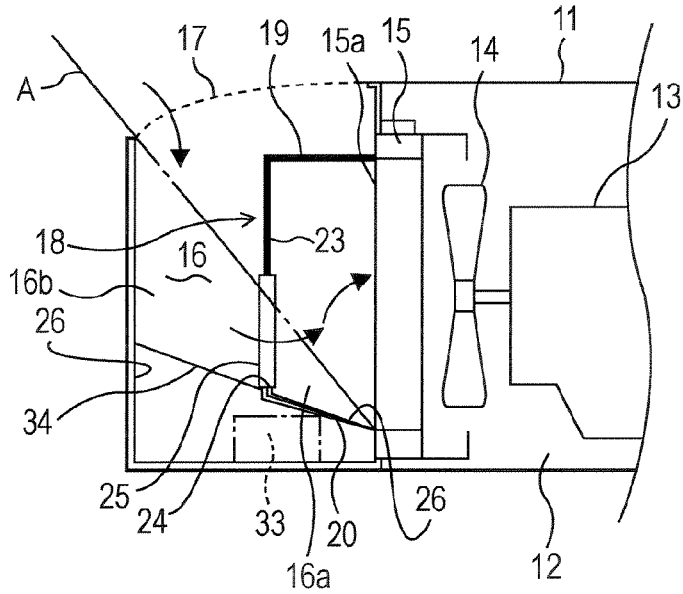
FIG. 9 is a schematic cross-sectional view showing Example 4 of the present invention.
Figure 10:
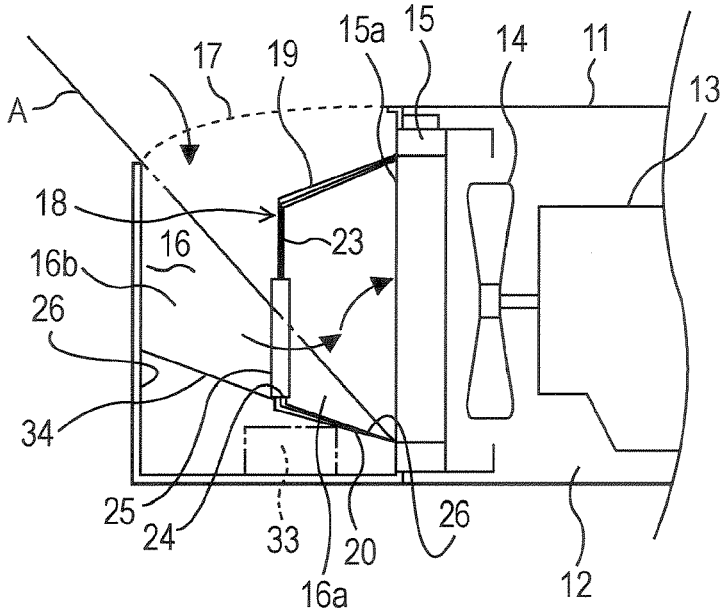
FIG. 10 is a schematic cross-sectional view showing Example 5 of the present invention.

(See FIGS. 9, 10)

In Examples 4, 5, a bottom plate (20) of a duct is formed so as to be declined toward the core surface (15*a*) of a heat exchanger.

With this arrangement, the occurrence of stagnation or turbulence of air in the lower space of the duct (18) is suppressed, and the airflow in the duct (18) becomes smoothened, compared with the case of both Examples 1, 2 in which the bottom plate (20) of the duct is disposed in a horizontal position.

Additionally, the enlarged space under the duct can be utilized as a place for installing equipment such as a battery and the like and/or a tool box (called equipment, etc.) (33). This arrangement provides an advantage that the equipment, etc. (33) are covered with the duct (18) and can be protected from rain.

In both the Examples, a guide plate (34) is installed in an inlet portion of a second air intake port (24) in a lower space of a second chambers (16*b*).

The guide plate (34) is configured so as to be declined toward the lower edge of the second air intake port (24) as shown in the attached figure.

According to this configuration, the flow of air sucked from above is directed 90° by the guide plate (34) in the inlet portion of the second air intake port (24), and can be certainly guided to the second air intake port (24).

In addition to the effect, the declined guide plate (34) enables occurrence of stagnation or turbulence of air in the inlet portion of the second air intake port (24) to be suppressed.

In this case, if the space between the top plate (19) of the duct and a first air intake port (17) is large enough, and air intake volume can be secured by fully utilizing the opening area of the first air intake port (17), the top plate (19) of the duct can be formed in a horizontal position as shown in FIG. 9.

It is noted that although the configuration described here is predicated on that of Example 1, the configuration of both Examples 3, 4 can be also predicated on that of Example 2.

EXAMPLE 6

Figure 11:
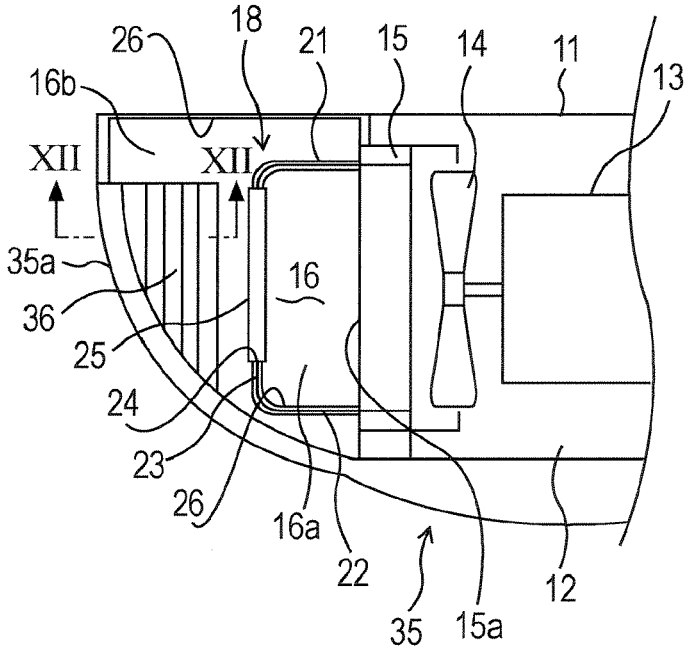
FIG. 11 is a view showing Example 6 of the present invention, corresponding to FIG. 3.
Figure 12:
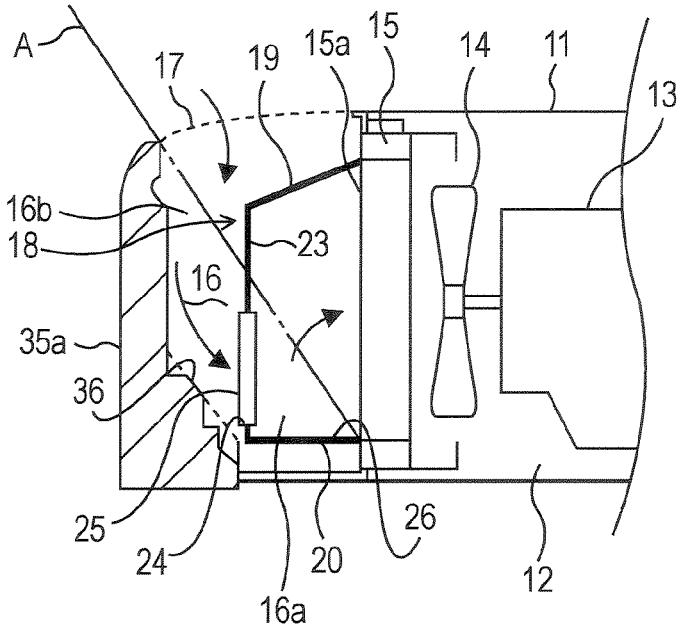
FIG. 12 is a cross-sectional view taken from line VII-VII of FIG. 11.

(See FIGS. 11, 12)

In this Example 6, in a so-called small rear-swing radius type of machine (including ultra-small rear-swing radius type) having a counterweight (35) that is also used as a cover member in the rear portion of the engine room (12) and has left and right side portions (only the left side portion is shown in the attached figure) (35*a*) formed so as to be curved toward side ends of the engine room (12), an air guide surface (36), being configured to guide intake air to the second air intake port (24), is formed on the lower inner surface of the left side portion (35*a*) of left and right portions of the counterweight (35) facing to the air intake chamber (16) so as to be declined stepwise toward the forward end.

Due to providing the air guide surface (36) in this arrangement, the air flow in the inlet portion of the second air intake port (24) can be improved. Namely, a good air intake performance can be obtained without adding any separate guide plate, and a manufacturing cost becomes cheap.

In this case, incidentally, the air guide surface (36) is formed stepwise due to restrictions on molding the counterweight (35), and the like, but if there is not such a restriction, it is desirable to make the air guide surface (36) so as to be declined straight toward a forward end as shown by a two-dot chain line in FIG. 12.

It is noted that although the configuration described here is predicated on that of Example 1, the configuration of this Example 6 can be also predicated on that of other Examples.

EXAMPLE 7

Figure 13:
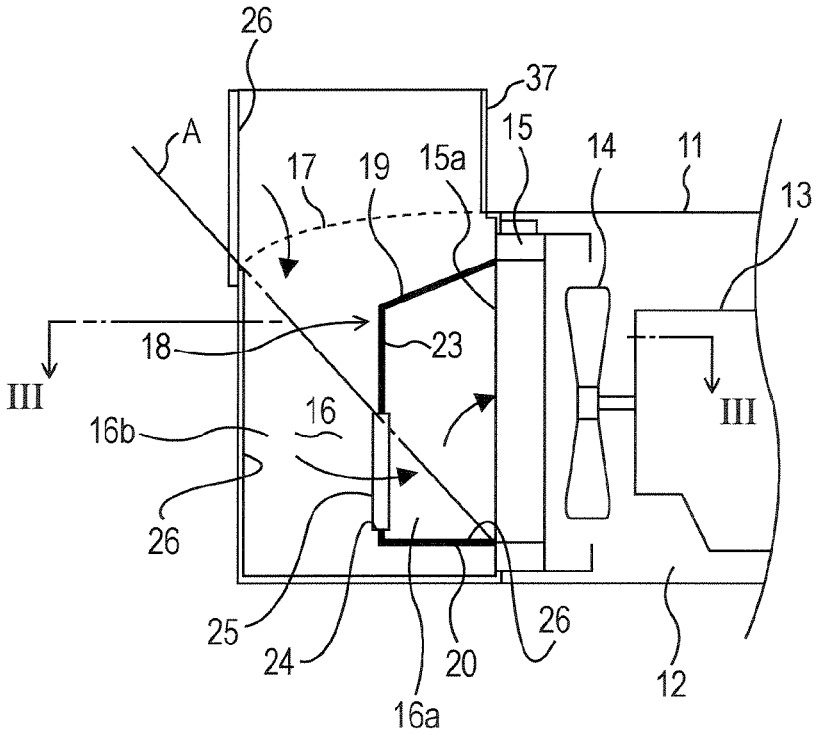
FIG. 13 is a schematic cross-sectional view showing Example 7 of the present invention.

(See FIG. 13)

In Example 7, there is provided an air intake pipe (37) projected upward on a first air intake port (17), inside which sound-absorbing material (26) is attached.

With this arrangement, noise is released upward to a high position by the air intake pipe (37) regardless of whether the first air intake port (17) is located at a high position or a low position, and even in the case that a second air intake port (24) is formed in a vertically large area as in Examples 2, 3, so "noise on the side of the machine" can be further reduced.

Since the sound-absorbing material (26) is attached inside the air intake pipe (37), the effect of reducing "noise on the side of the machine" becomes much increased.

It is noted that an entire duct (18) may be formed into one piece by means of plastic molding or press work in each case of Examples 1 to 6 that employ a duct method.

EXAMPLE 8

Figure 14:
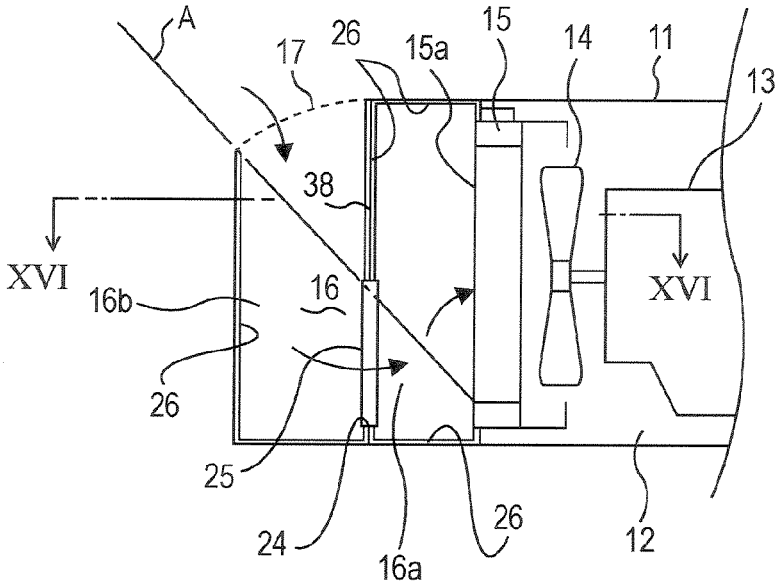
FIG. 14 is a schematic cross-sectional view showing Example 8 of the present invention.
Figure 15:
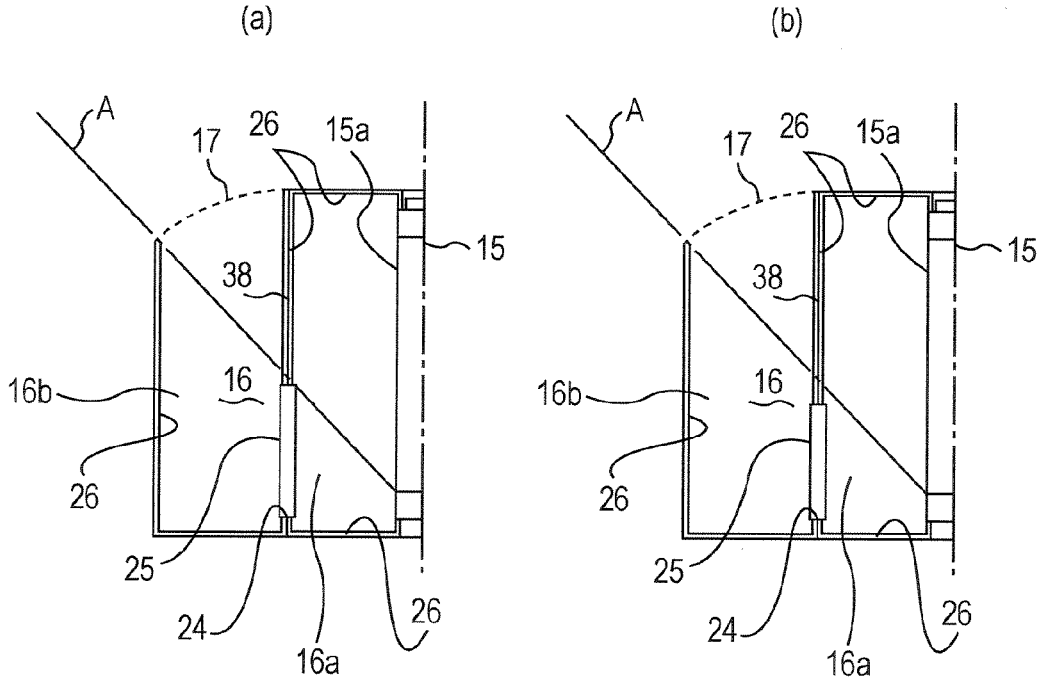
FIGS. 15(*a*), (*b*) are partial cross-sectional views showing other two examples for the position of the upper end of a second air intake port.
Figure 16:
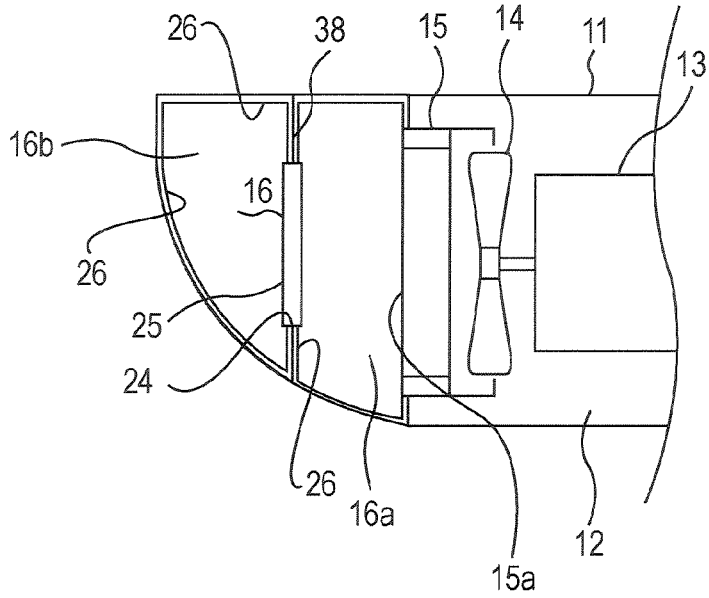
FIG. 16 is a cross-sectional view taken from line XVI-XVI of FIG. 14.

(See FIGS. 14 to 16)

In the following Examples 8 to 13, there is provided a shield plate (38) in an air intake chamber (16) as a shield member, but since other basic configurations are the same with examples 1 to 7, the same constituents as previous ones are respectively denoted as the same reference numeral, and the repeated explanation thereof is omitted.

In Example 8, a shield plate (38) is formed as a rectangular plate-like member, and disposed vertically so as to oppose the core surface (15*a*) of a heat exchanger (that is, in parallel with the core surface (15*a*)) in a manner that the periphery thereof is in entirely contact with a cover member (11) in every direction, and an air intake chamber (16) is partitioned thereby into a first chamber (16*a*) of the side of the heat exchanger (15) and a second chamber (16*b*) of the opposite side over the full width of the air intake chamber.

It is noted that the width of the air intake chamber (16) denotes a dimension in the up-and-down direction on the plan view of FIG. 3, and also the front-and-rear direction of the machine.

There is provided a second air intake port (24) in the shield plate (38), the second air intake port (24) being opened horizontally and covered with a dust-proof filter (25), which is mounted in parallel with the core surface (15*a*) of the heat exchanger.

Incidentally, due to the filter (25) (the second air intake port (24)) disposed in parallel with the core surface (15*a*), the airflow in the first chamber (16*a*) becomes improved.

Thanks to the shield plate (38), an air intake passage bent in an L-shape is formed in which outside air taken through a first air intake port (17) in a downward direction as shown by an arrow in FIG. 14 is directed sideway at the second air intake port (24) and is fed to the core surface (15*a*) of the heat exchanger.

Since the air intake passage connecting between the core surface (15*a*) and the outside is bent in an L-shape by the shield plate (38) as described above, direct sound being emitted directly to the outside can be intercepted by the shield plate (38), as similar with the duct method in Examples 1 to 7.

In this case, relative positions of the first and second air intake ports (17), (24) are set so that any portion of the core surface (15*a*) of the heat exchanger should not be directly seen from the outside through either of the air intake ports (17), (24).

Specifically, the top edge of the second air intake port (24) is positioned on or below a straight line (A) connecting between the bottom edge of the core surface (15*a*) of the heat exchanger and the utmost outside of the first air intake port (17).

Thus, direct sound being emitted from the core surface (15*a*) directly to the outside can be reliably intercepted by the shield plate (38).

According to this layout, the top edge of the second air intake port (24) is consequentially located below the lowest end of the first air intake port (17) (the portion transitioning to a side face of the machine, shown in the left end of the attached exemplary figures), so there is no fear that sound is directly emitted toward a side of the machine. Namely, "noise on the side of the machine" can be significantly reduced.

In FIG. 14, there is shown a first pattern in which the top edge of the second air intake port is positioned on the straight line (A), but as with in FIG. 2, a second pattern in which it is positioned near and slightly below the straight line (A) as shown in FIG. 15(*a*), or a third pattern in which it is positioned apparently below the straight line (A) as shown in FIG. 15(*b*) may also be employed.

As described in the case of Example 1, the top edge of the second air intake port may also be positioned slightly above the straight line (A).

On the other hand, air intake sound emitted from the core surface (15*a*) is, as with the duct method, repeatedly reflected and attenuated between the first and second chambers (16*a*), (16*b*) in the air intake chamber (16); thereby, a high soundproof effect can be obtained.

Additionally, in comparison with a single duct structure of the air intake chamber (16), since being formed in a horizontal double-wall structure with use of the shield plate (38), it becomes possible to substantially increase its soundproof effect by blocking sound doubly with the shield plate (38) and the cover member (11) forming the air intake chamber (16).

Another soundproof effect can be obtained by squeezing sound with the second air intake port (24).

Through the structural features described above, it is possible to obtain a soundproof effect nearly equivalent to the duct method illustrated in Examples 1 to 7.

The following features and effects thereby are obtained as with Examples 1 to 6.

(i) A feature that the area of a second air intake port (24) is smaller than that of the core surface (15*a*) of a heat exchanger, and the effect of this feature.

(ii) An effect that it is not needed to enlarge an air intake chamber as done in a known art for the reason that the above effects are obtained by providing a shield plate (38) in an air intake chamber (16).

(iii) An effect that the efficiency of removing dust and the like contained in the outside air sucked from the first air intake port (17) becomes high since a filter (25) is installed in the second air intake port (24) of the shield plate (38).

(iv) An effect that, compared with the case that the core surface (15*a*) is fully covered with a filter, the filter (25) is formed in a considerably smaller size, and still the same function is maintained, by which a cost reduction is achieved.

(v) A feature that sound-absorbing material (26) is provided on the wall surface of the air intake chamber (16), i.e., the inner surface of the cover member (11) forming the air intake chamber (16), and on both surfaces of the shield plate (38), and due to the sound absorption effect of the sound-absorbing material (26) intake noise can be further reduced, and the effect of this feature.

EXAMPLE 9

Figure 17:
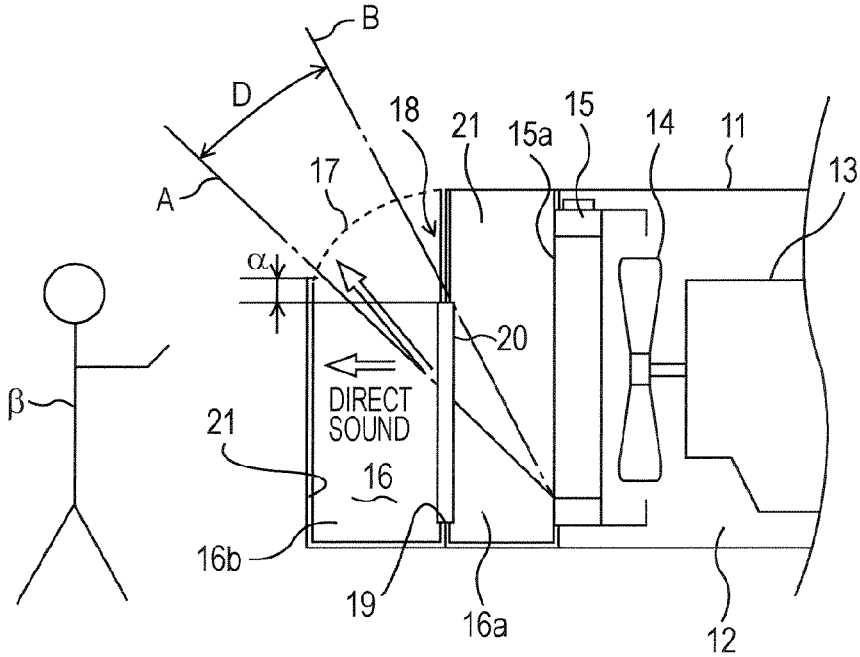
FIG. 17 is a schematic cross-sectional view showing Example 9 of the present invention.

(See FIG. 17)

Only the points different from Example 8 are described.

In order to suppress "noise on the side of the machine" that a man standing near the machine perceives, it is preferable that intake noise is emitted upwardly; therefore, a first air intake port (17) is desirable to be formed on the top face of an air intake chamber (16), or, even in the case that the rear end of the first air intake port (17) is extended to the side face of the machine, it is desirable that it ends at a position close to the upper end of the side face of the machine as in the case of example 8.

However, there may be a case that the first air intake port (17) is desirable to be formed so as to be much extended to the side face as shown in FIG. 17 for convenience of a layout or on requirement for increasing outside air to be taken in.

In Example 1, the top edge of the second air intake port (24) is positioned on or below the straight line (A) connecting between the bottom edge of the core surface (15*a*) of the heat exchanger and the utmost outside of the first air intake port (17) as described above; consequently, the vertical dimension of the second air intake port (24) is limited and the area thereof becomes narrow, which may cause a problem that air volume taken through the second air intake port (24) is reduced. Furthermore, since the second air intake port (24) is located in a lower position, there arises a fear that cooling air flowing in the first chamber (16*a*) in the duct via the second air intake port (19) may not be sufficiently delivered to the upper portion of the core surface (15*a*) of the heat exchanger.

Then, it becomes desirable that the vertical dimension of the second air intake port (24) is more extended.

As a configuration responding to such a requirement, in Example 2, the position and size of the second air intake port (19) is firstly set so that the top edge of the second air intake port (24) is positioned above the straight line (A). Specifically, the second air intake port (24) is formed in an extended area from a lower part close to the bottom edge of the shield plate (38) to an upper portion thereof as shown in the attached figure.

On the other hand, the first air intake port (17) is formed in a large area extended to the side face from the upper surface portion of the air intake chamber with a condition that the low end of the first air intake port (17) is positioned above the upper end of the second air intake port (24). The sign (α) in FIG. 17 denotes a position deviation between the low end of the first air intake port and the upper end of the second air intake port.

With this configuration of Example 9, the first air intake port (17) is formed in a large area extended to the side face and also the second air intake port (24) is formed in a vertically extended area, while "noise on the side of the machine" that a worker (β) standing near the machine perceives can be reduced, because a horizontally directed portion of noise being emitted from the core surface (15*a*) of the heat exchanger is blocked by the side face portion of the cover member (11), and only the upwardly directed portion of noise is dissipated upward from the first air intake port (17).

Even in this case, the following basic effects with the configuration that the shield plate (38) is installed in front of the core surface (15*a*) of the heat exchanger are still assured.

(a) Direct sound being emitted from the core surface (15*a*) of the heat exchanger directly toward the outside can be intercepted by the shield plate (38) and its dissipation can be suppressed.

(b) A sound reflection-attenuation effect can be obtained by both the chamber wall (cover member (11)) of the air intake chamber (16) and the shield plate (38).

(c) Since the air intake chamber is formed in a doubled structure by being partitioned with the shield plate (38), sound leakage through clearances in the chamber wall is effectively suppressed.

(d) A sound attenuation effect caused by being squeezed with the shield plate (38) is obtained.

EXAMPLE 10

Figure 18:
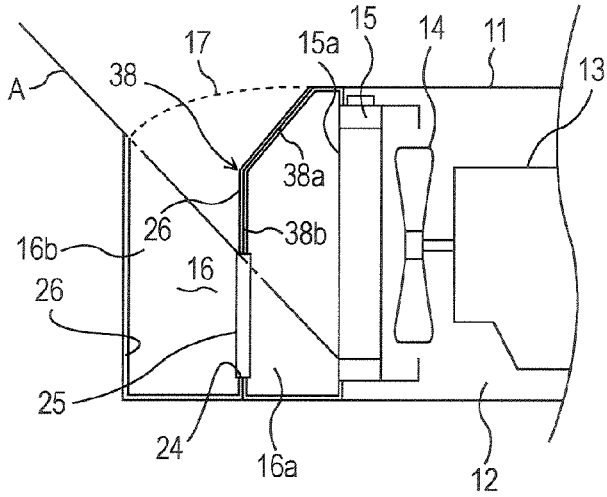
FIG. 18 is a schematic cross-sectional view showing Example 10 of the present invention.

(See FIG. 18)

In the following Examples 10. 11, only the points different from Example 8 are described.

In Example 10, to secure a large opening area, a first air intake port (17) is formed so as to be extended to the side of a heat exchanger (15) compared with Example 7.

On the other hand, a shield plate (38) is composed of a top plate portion (38*a*) opposing the first air intake port (17) and a vertical plate portion (38*b*) being placed in parallel with the core surface (15*a*) of the heat exchanger, and a second air intake port (24) is provided in the vertical plate portion (38*b*).

In this arrangement, the top plate portion (38*a*) of the shield plate (38) is formed so as to be declined toward a forward end (in the direction in which the space between the top plate portion (38*a*) and the first air intake port (17) becomes larger with distance from the core surface (15*a*) of the heat exchanger) to prevent the first air intake port (17) from being blocked; thereby, sufficient air volume can be secured by fully utilizing the open area of the first air intake port (17).

As with Example 8, the top edge of the second air intake port (24) is positioned on the straight line (A) or at a position close, as much as possible, to the line to prevent the core surface (15*a*) of the heat exchanger from being directly seen from the outside.

The shield plate (38) employed in respective Examples 8 to 10, and also in Examples 11 to 13 being described below may be formed of a metal plate material or entirely molded of plastic material.

Also in this Example 10, a soundproof effect equivalent to Example 8 can be basically obtained.

EXAMPLE 11

Figure 19:
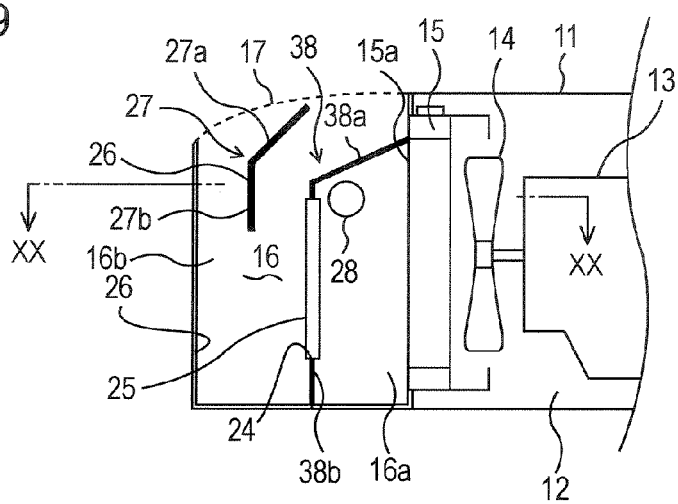
FIG. 19 is a schematic cross-sectional view showing Example 11 of the present invention.
Figure 20:
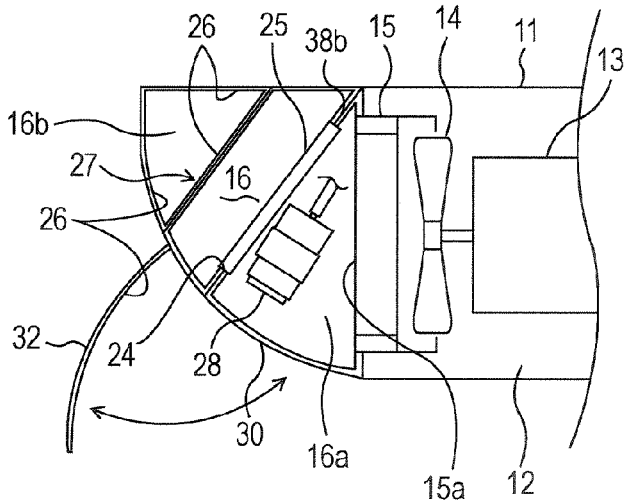
FIG. 20 is a cross-sectional view taken from line XX-XX of FIG. 19.
Figure 21:
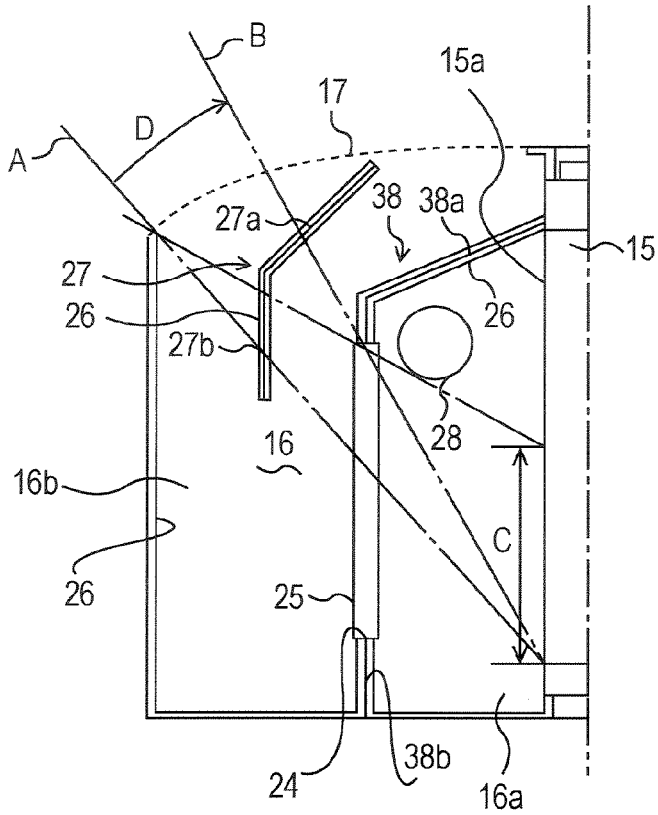
FIG. 21 is a magnified view of a part of FIG. 19.

(See FIGS. 19 to 21)

This Example 11 is predicated on the configuration of Example 10 that a shield plate (38) is composed of a top plate portion (38*a*) and a vertical plate portion (38*b*).

In contrast to Examples 8 to 10, the shield plate (38) is disposed so that the vertical plate portion (38*b*) is inclined with respect to the core surface (15*a*) of a heat exchanger as shown in FIG. 20. The same soundproof effect as in Examples 8 to 10 can be basically obtained also in this case. It is noted, however, that the following configuration can also be applied to the case in which the vertical plate portion (38*b*) is placed in parallel with the core surface (15*a*) of a heat exchanger.

Example 11 corresponds to Example 3 (FIGS. 5 to 8) employing a duct method.

That is, a second air intake port (24) is formed in an extended area from a position close to the upper edge of the vertical plate portion (38*b*) of the shield plate (38) to a position close to the lower edge thereof so that the top edge of the second air intake port (24) is positioned above the straight line (A).

With this arrangement, it becomes possible to increase air volume taken through the second air intake port (24) and to deliver the intake air thoroughly to the upper portion of the core surface (15*a*) of the heat exchanger.

In order to intercept direct sound from a directly visible portion (C) of the core surface (15*a*) of the heat exchanger, being an adverse effect of this configuration, there is provided a curtain plate (27) between the first air intake port (17) and the second air intake port (24) (the shield plate (38)), the curtain plate (27) having both functions of guiding air and blocking the direct sound.

As with Example 3, the curtain plate (27) is configured as an angled plate having an inclined portion (27*a*) inclined in the same direction as the top plate portion (38*a*) of the shield plate (38) and a vertical portion (27*b*) downwardly extended from the lower end of the inclined portion (27*a*), and is installed so as to shield at least a directly visible portion (C) of the core surface (15*a*) from the outside.

Also as with Example 3, it becomes possible to deliver the air sucked from the first air intake port (17) to the entire area of the second air intake port (24), i.e., the entire core surface (15*a*) of the heat exchanger by installing the curtain plate (27) as described above, and also possible to perfectly block the sound being directly emitted from the core surface (15*a*) of the heat exchanger toward the first air intake port (17) since the directly visible portion (C) of the core surface (15*a*) is shielded from the outside by the curtain plate (27).

It is noted that, also in this Example, the curtain plate (27) may be installed so as to cover a minimum area including the area (D) between the straight lines (A), (B) in FIG. 21. There is also provided sound-absorbing material (26) on both side surfaces of the curtain plate (27).

Also as with Example 3, furthermore, an air cleaner (28) is provided in the upper portion (or alternatively in the middle or lower portion) of the first chamber (16*a*), and in order to make it easier to carry out maintenance such as inspection, cleaning, replacement or the like of the element and filter (25) of the air cleaner (28) from the outside, a maintenance port (30) and a door (32) for closing or opening the maintenance port are formed on the side face (a back portion) of the cover member (11) from which the element and filter (25) can be attached or detached as shown in FIG. 20.

In both Examples 10, 11, if the space between the top plate portion (38*a*) of the shield plate and the first air intake port (17) is large enough, and air intake volume can be secured by fully utilizing the opening area of the first air intake port (17), the top plate portion (38*a*) of the shield plate can be formed in a horizontal position.

EXAMPLE 12

Figure 22:
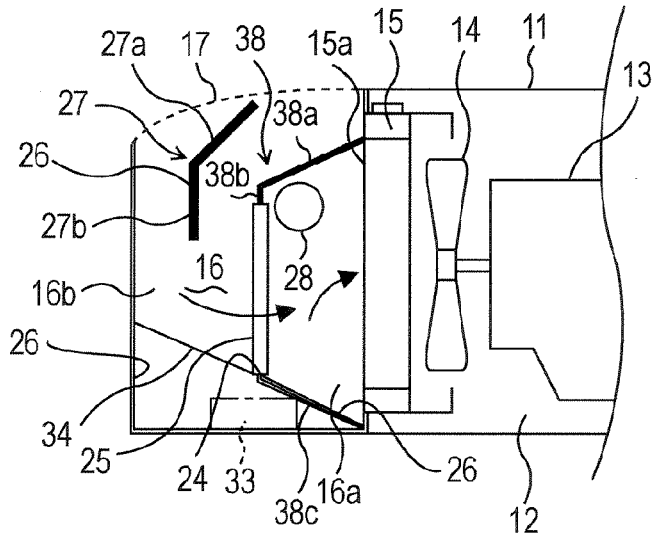
FIG. 22 is a schematic cross-sectional view showing Example 12 of the present invention.

(See FIG. 22)

This Example 12 corresponds to Examples 4, 5 (FIGS. 9, 10) employing a duct method.

In Example 12, the lower portion (the bottom portion of a vertical plate portion (38*b*)) (38*c*) of a shield plate is formed so as to be declined toward a heat exchanger for the purpose to suppress occurrence of stagnation or turbulence of air in the lower portion of a second chamber (16*b*), and also to acquire a space beneath the shield plate for installing equipment, etc. (33).

In addition to the above, a guide plate (34) is installed in an inlet portion of a second air intake port (24) so as to be declined toward the lower edge of the second air intake port (24) for the purpose to direct the flow of air sucked from above in the inlet portion at the angle 90° to certainly guide to the second air intake port (24), and also for the purpose to suppress occurrence of stagnation or turbulence of air in the inlet portion of the second air intake port (24).

EXAMPLE 13

Figure 23:
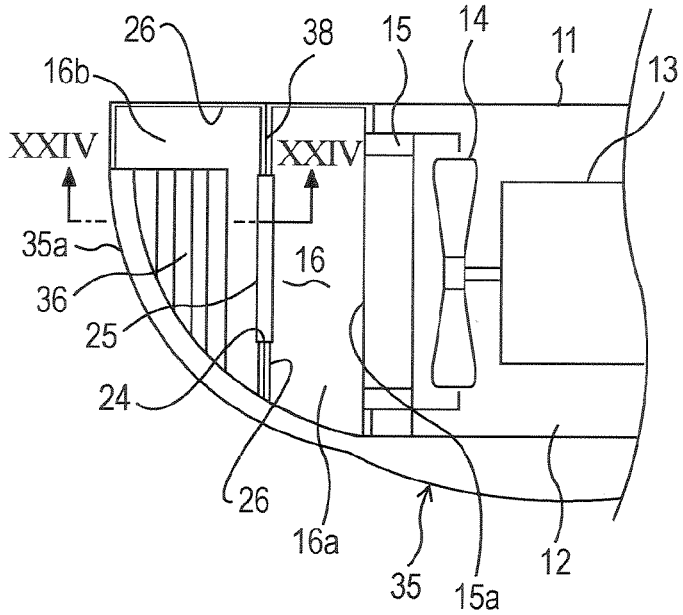
FIG. 23 is a view showing Example 13 of the present invention, corresponding to FIG. 16.
Figure 24:
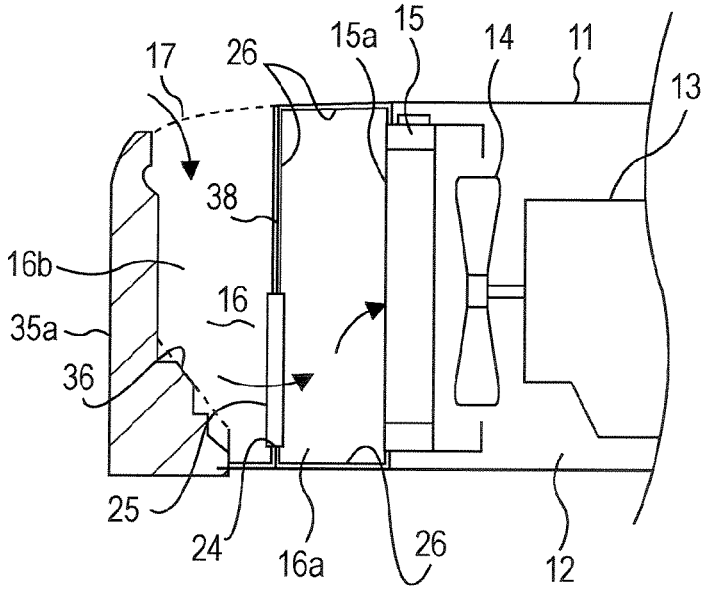
FIG. 24 is a cross-sectional view taken from line XXIV-XXIV of FIG. 23.

(See FIGS. 23, 24)

This Example 13 corresponds to Example 6, (FIGS. 11, 12) employing a duct method.

That is, in a so-called small rear-swing radius type of machine (including ultra-small rear-swing radius type) having a counterweight (35) that is also used as a cover member in the rear portion of the engine room (12) and has left and right side portions (only the left side portion is shown in the attached figure) (35*a*) formed so as to be curved toward side ends of the engine room (12), an air guide surface (36), being configured to guide intake air to the second air intake port (24), is formed on the lower inner surface of the left side portion (35*a*) of left and right portions of the counterweight (35) facing to the air intake chamber (16) so as to be declined stepwise toward the forward end, in which the second air intake port (24) is located, for the purpose to improve the airflow in the inlet portion of the second air intake port (24).

Although the configuration described here is predicated on that of Example 8, the configuration of this Example 13 can be also applied to Examples 9 to 12 respectively.

Although it is omitted to show a figure and give a description as an example, the configuration of Example 7 (FIG. 13), employing a duct method, that an intake pipe (37) projected upward is provided on a first air intake port (17) can be applied to the case employing a shield plate method in a like manner.

OTHER EXAMPLES (1) In Example 3 shown in FIGS. 5 to 8, and in Example 11 shown in FIGS. 19 to 21, such a configuration is employed that the vertical dimension of the second air intake port (24) is extended, and at the same time a curtain plate (27) is installed to shield the directly visible portion (C) of the core surface (15*a*) of the heat exchanger, but the curtain plate (27) may be installed only when required. Basic soundproof effects described above, obtained by providing a duct (18) or a shield plate (38), can be secured even without installing the curtain plate (27).

(2) A first air intake port (17) may be provided on a side face part (an area not overlapped or partially overlapped with the upper face part) in the front-and-rear direction or left-and-right direction of an intake chamber (16).

In this case, it is preferable that the first air intake port (17) is provided in a chamber wall not opposing a second air intake port (24). If provided in a chamber wall opposing the second air intake port (24), the first air intake port (17) should be formed on the condition that the lower edge thereof is positioned above the upper edge of the second air intake port (24).

(3) In respective Examples 8 to 13 shown in FIGS. 14 to 24 employing a shield plate method, such a configuration is employed that the lower edge of a shield plate (38) reaches to the bottom surface portion of a cover member (11), but such a configuration may also be employed that the lower edge of a shield plate (38) ends at a position above the bottom surface portion of the cover member (11), and the opening part formed between the lower edge of the shield plate (38) and the bottom surface portion of the cover member (11) may be used as a second air intake port (24).

In this case, a filter (25) may be disposed so that its upper edge touches the shield plate (38), its front and rear edges respectively touch the front and rear side surfaces of the cover member (11), and its lower edge touches the bottom surface of the cover member (11).

Industrial Applicability

According to the present invention, in a construction machine such as a hydraulic excavator or the like, a useful effect that the soundproof performance on the air intake side of an engine room is improved.

The invention claimed is:

1. A cooling structure of a construction machine equipped with an engine room in which an engine, a heat exchanger and a cooling fan are installed, and into which outside air is sucked by rotation of the cooling fan to be passed through the heat exchanger, the engine room being covered with a cover member, wherein an air intake chamber is formed in the air intake side of the heat exchanger by being separated from the other space in the engine room; a first air intake port open to the outside is provided in a chamber wall of the air intake chamber, the chamber wall being formed of the cover member; a shield member having a face opposing the core surface of the heat exchanger is provided in the front side of the core surface so as to partition the air intake chamber disposed between the core surface and the first air intake port into two chambers; and a second air intake port is provided in the face of the shield member opposing the core surface, wherein a duct is independently formed using duct members different from the cover member in a manner such that the core surface of the heat exchanger is enclosed airtightly from the surrounding atmosphere, and is provided with the second air intake port.

2. The cooling structure of a construction machine according to claim 1, wherein the second air intake port is provided in a manner such that a bent air intake passage is formed between the first air intake port and the core surface of the heat exchanger so that air sucked from the first air intake port is directed at the second air intake port and is passed to the core surface of the heat exchanger.

3. The cooling structure of a construction machine according to claim 2, wherein the first and second air intake ports are disposed so that the air intake passage is formed so as to be roughly L-shaped.

4. The cooling structure of a construction machine according to claim 1, wherein the first air intake port is provided in a manner such that at least a part thereof is positioned in a side face portion of the chamber wall of the air intake chamber and also the lower edge thereof is positioned above the upper edge of the second air intake port.

5. The cooling structure of a construction machine according to claim 1, wherein the shield member is provided in a manner such that the core surface of the heat exchanger cannot be directly seen from the outside through either of the first and second air intake ports.

6. The cooling structure of a construction machine according to claim 1, wherein the area of the second air intake port is smaller than that of the core surface of the heat exchanger.

7. The cooling structure of a construction machine according to claim 1, wherein the shield member has a wall surface opposing the first air intake port, and is declined with distance from the core surface of the heat exchanger, as being provided with bigger space between the wall surface thereof and the first air intake port.

8. The cooling structure of a construction machine according to claim 1, wherein the lower portion of the shield member is declined toward the front where the heat exchanger is located.

9. A cooling structure of a construction machine equipped with an engine room in which an engine, a heat exchanger and a cooling fan are installed, and into which outside air is sucked by rotation of the cooling fan to be passed through the heat exchanger, the engine room being covered with a cover member, wherein an air intake chamber is formed in the air intake side of the heat exchanger by being separated from the other space in the engine room; a first air intake port open to the outside is provided in a chamber wall of the air intake chamber, the chamber wall being formed of the cover member; a shield member having a face opposing the core surface of the heat exchanger is provided in the front side of the core surface so as to partition the air intake chamber disposed between the core surface and the first air intake port into two chambers; and a second air intake port is provided in the face of the shield member opposing the core surface, wherein a shield plate is provided as the shield member so as to partition the space between the core surface and the first air intake port over the full width of the air intake chamber.

10. A cooling structure of a construction machine equipped with an engine room in which an engine, a heat exchanger and a cooling fan are installed, and into which outside air is sucked by rotation of the cooling fan to be passed through the heat exchanger, the engine room being covered with a cover member, wherein an air intake chamber is formed in the air intake side of the heat exchanger by being separated from the other space in the engine room; a first air intake port open to the outside is provided in a chamber wall of the air intake chamber, the chamber wall being formed of the cover member; a shield member having a face opposing the core surface of the heat exchanger is provided in the front side of the core surface so as to partition the air intake chamber disposed between the core surface and the first air intake port into two chambers; and a second air intake port is provided in the face of the shield member opposing the core surface, wherein a guide plate configured to guide air sucked from the first air intake port toward the second air intake port is provided between a duct and the first air intake port in the air intake chamber.

11. The cooling structure of a construction machine according to claim 10, wherein a guide plate is formed in an inlet portion of a second air intake port in a manner such that sucked air is directed toward the second air intake port.

12. The cooling structure of a construction machine according to claim 11, wherein the guide plate is formed so as to be declined toward the lower periphery portion of the second air intake port.

13. A cooling structure of a construction machine equipped with an engine room in which an engine, a heat exchanger and a cooling fan are installed, and into which outside air is sucked by rotation of the cooling fan to be passed through the heat exchanger, the engine room being covered with a cover member, wherein an air intake chamber is formed in the air intake side of the heat exchanger by being separated from the other space in the engine room; a first air intake port open to the outside is provided in a chamber wall of the air intake chamber, the chamber wall being formed of the cover member; a shield member having a face opposing the core surface of the heat exchanger is provided in the front side of the core surface so as to partition the air intake chamber disposed between the core surface and the first air intake port into two chambers; and a second air intake port is provided in the face of the shield member opposing the core surface, wherein a curtain plate is provided in the air intake chamber, in which a portion of the core surface of the heat exchanger can be directly seen from the outside through both the first and second air intake ports, so as to prevent the core surface portion from being directly seen from the outside.

14. The cooling structure of a construction machine according to claim 13, wherein the curtain plate is formed so as to also serve as a guide plate configured to guide air sucked from the first air intake port toward the second air intake port.

15. A cooling structure of a construction machine equipped with an engine room in which an engine, a heat exchanger and a cooling fan are installed, and into which outside air is sucked by rotation of the cooling fan to be passed through the heat exchanger, the engine room being covered with a cover member, wherein an air intake chamber is formed in the air intake side of the heat exchanger by being separated from the other space in the engine room; a first air intake port open to the outside is provided in a chamber wall of the air intake chamber, the chamber wall being formed of the cover member; a shield member having a face opposing the core surface of the heat exchanger is provided in the front side of the core surface so as to partition the air intake chamber disposed between the core surface and the first air intake port into two chambers; and a second air intake port is provided in the face of the shield member opposing the core surface, wherein an air intake pipe projecting upward is provided on the first air intake port.

16. The cooling structure of a construction machine according to claim 15, wherein sound-absorbing material is attached inside the air intake pipe.

17. A cooling structure of a construction machine equipped with an engine room in which an engine, a heat exchanger and a cooling fan are installed, and into which outside air is sucked by rotation of the cooling fan to be passed through the heat exchanger, the engine room being covered with a cover member, wherein an air intake chamber is formed in the air intake side of the heat exchanger by being separated from the other space in the engine room; a first air intake port open to the outside is provided in a chamber wall of the air intake chamber, the chamber wall being formed of the cover member; a shield member having a face opposing the core surface of the heat exchanger is provided in the front side of the core surface so as to partition the air intake chamber disposed between the core surface and the first air intake port into two chambers; and a second air intake port is provided in the face of the shield member opposing the core surface, wherein a filter is installed on the shield member so as to cover the second air intake port.

18. A cooling structure of a construction machine equipped with an engine room in which an engine, a heat exchanger and a cooling fan are installed, and into which outside air is sucked by rotation of the cooling fan to be passed through the heat exchanger, the engine room being covered with a cover member, wherein an air intake chamber is formed in the air intake side of the heat exchanger by being separated from the other space in the engine room; a first air intake port open to the outside is provided in a chamber wall of the air intake chamber, the chamber wall being formed of the cover member; a shield member having a face opposing the core surface of the heat exchanger is provided in the front side of the core surface so as to partition the air intake chamber disposed between the core surface and the first air intake port into two chambers; and a second air intake port is provided in the face of the shield member opposing the core surface, wherein a counterweight, also serving as a covering material, is provided in the rear of the engine room, the counterweight having a shape such that both the left and right side portions thereof are curved toward the side ends of the engine room, and the inner surface of one side portion of its left and right portions facing to the air intake chamber is declined as an air guide surface configured to guide sucked air to the second air intake port.

19. A cooling structure of a construction machine equipped with an engine room in which an engine, a heat exchanger and a cooling fan are installed, and into which outside air is sucked by rotation of the cooling fan to be passed through the heat exchanger, the engine room being covered with a cover member, wherein an air intake chamber is formed in the air intake side of the heat exchanger by being separated from the other space in the engine room; a first air intake port open to the outside is provided in a chamber wall of the air intake chamber, the chamber wall being formed of the cover member; a shield member having a face opposing the core surface of the heat exchanger is provided in the front side of the core surface so as to partition the air intake chamber disposed between the core surface and the first air intake port into two chambers; and a second air intake port is provided in the face of the shield member opposing the core surface, wherein sound-absorbing material is attached on the wall surface of the air intake chamber.

20. A cooling structure of a construction machine equipped with an engine room in which an engine, a heat exchanger and a cooling fan are installed, and into which outside air is sucked by rotation of the cooling fan to be passed through the heat exchanger, the engine room being covered with a cover member, wherein an air intake chamber is formed in the air intake side of the heat exchanger by being separated from the other space in the engine room; a first air intake port open to the outside is provided in a chamber wall of the air intake chamber, the chamber wall being formed of the cover member; a shield member having a face opposing the core surface of the heat exchanger is provided in the front side of the core surface so as to partition the air intake chamber disposed between the core surface and the first air intake port into two chambers; and a second air intake port is provided in the face of the shield member opposing the core surface, wherein an air cleaner for filtering air supplied to the engine is provided in a heat exchanger-side chamber partitioned with the shield member in the air intake chamber.

21. The cooling structure of a construction machine according to claim 20, wherein a maintenance port for carrying out maintenance at least of the air cleaner, and a door for closing or opening the maintenance port are provided.

* * * * *